United States Patent [19]

Sidaway et al.

[11] Patent Number: 4,709,723

[45] Date of Patent: Dec. 1, 1987

[54] SEPTIC TANK FOR ALTERNATIVE SEWER SYSTEMS

[75] Inventors: H. John Sidaway, Findlay; Donald A. Lytle, Tiffin, both of Ohio

[73] Assignee: Hancor, Inc., Findlay, Ohio

[21] Appl. No.: 887,077

[22] Filed: Jul. 17, 1986

[51] Int. Cl.[4] ..... F16K 24/00; E02D 29/14

[52] U.S. Cl. ..... 137/584; 137/592; 52/20; 52/169.6

[58] Field of Search ..... 137/583, 592, 584; 220/71; 52/169.5, 20, 19, 169.6

[56] References Cited

U.S. PATENT DOCUMENTS

| | | | |
|---|---|---|---|
| D. 233,887 | 12/1974 | Bower | D23/1 |
| D. 234,461 | 3/1975 | Piotrowski | D23/1 |
| D. 239,506 | 4/1976 | Myers | D9/3 |
| 3,662,918 | 5/1972 | Crawford et al. | 220/85 |
| 3,672,103 | 6/1972 | Kost | 52/169.6 |
| 3,938,689 | 2/1976 | de Munnik | 220/71 |
| 3,955,705 | 5/1976 | Dubois et al. | 220/71 |
| 4,254,885 | 3/1981 | Fouss et al. | 220/72 |
| 4,359,167 | 11/1982 | Fouss et al. | 220/72 |
| 4,475,845 | 10/1984 | Odill et al. | 52/20 |

FOREIGN PATENT DOCUMENTS

| | | | |
|---|---|---|---|
| 1486174 | 3/1969 | Fed. Rep. of Germany | 220/71 |
| 2567173 | 1/1986 | France | 52/20 |

OTHER PUBLICATIONS

Hancor Sewage Tank Advertising Brochure, Hancor, Inc., 1982.

Ensembles D'Assainissement Epuration Advertising Brochure, Sotralco.

HBA's Fiberglass Septic Tanks Advertising Brochure, HBA Cast Products Company.

La Fosse Septique En Polyethylene—Advertising Brochure of Wedco, Laval, P. Q.

*Primary Examiner*—A. Michael Chambers

*Attorney, Agent, or Firm*—Fay, Sharpe, Beall, Fagan, Minnich & McKee

[57] ABSTRACT

A corrugated plastic side wall (A) extends from a bottom area (14) to an apex area (12). A riser (B) extends from the apex area above the ground level. A ring of steel channel (10) is fastened around the apex area to prevent the apex area from becoming distorted when the soil in which the tank is buried becomes water-laden. A tank bottom wall (122) is domed inward to inhibit exterior hydraulic pressure from flexing the bottom inward and from urging the corrugated side walls adjacent the bottom to compress to a smaller diameter in an accordion-like fashion. Downward projecting can (124) and boxes (126) extend from the domed bottom surface to a flat plane to prevent the dome from flexing outward under the weight of sewage and other fluids in the interior of the tank. At least one annular projection (52) extends around an outlet opening (44) to enable a tank wall portion (54) adjacent the outlet opening and outlet tubing (48) to move relative to the remainder of the tank.

16 Claims, 6 Drawing Figures

FIG. 4
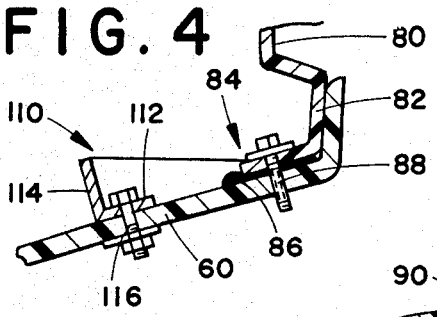
FIG. 5
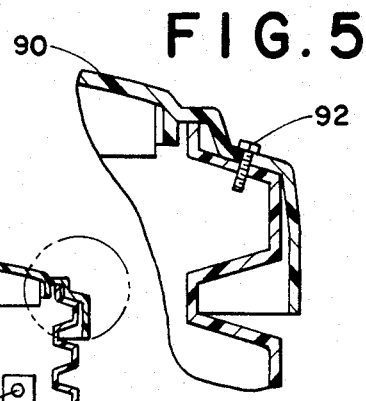
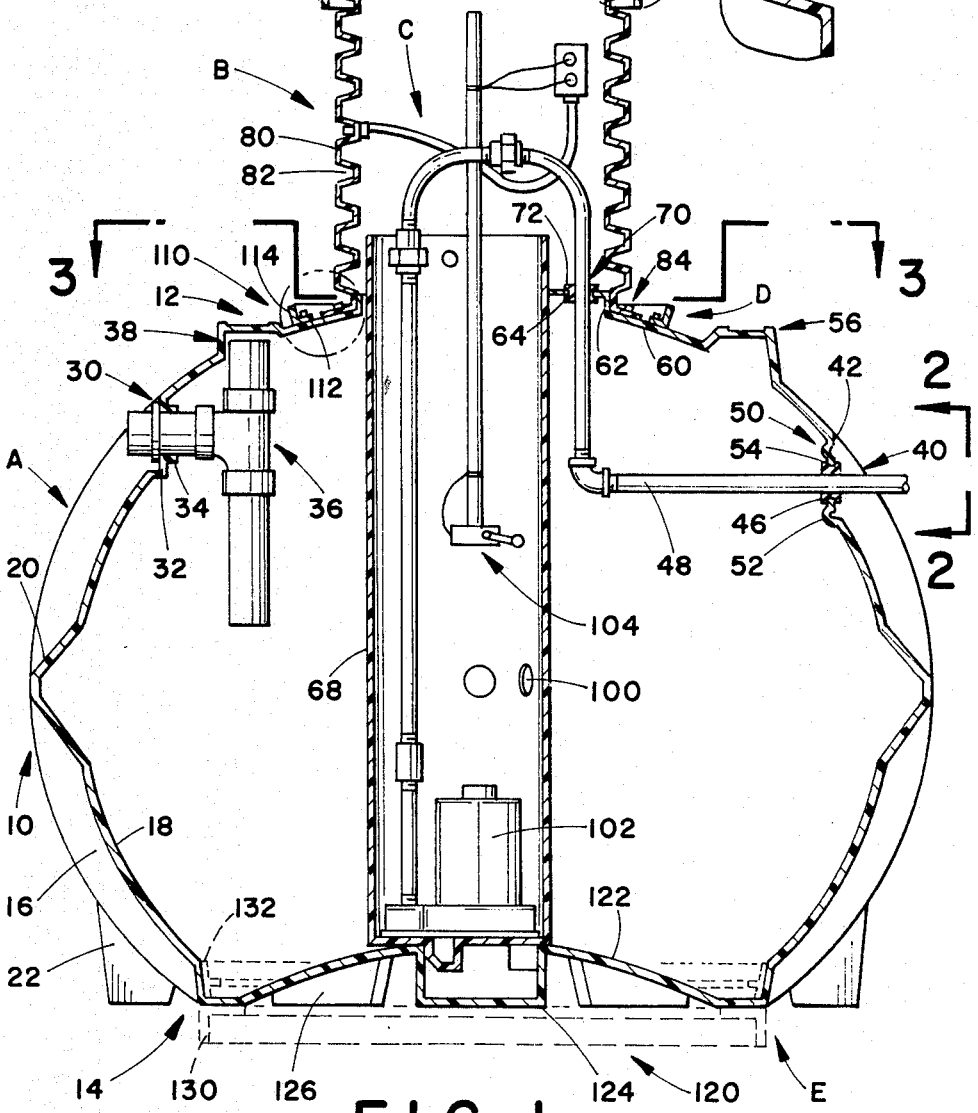
FIG. 1

SEPTIC TANK FOR ALTERNATIVE SEWER SYSTEMS

BACKGROUND OF THE INVENTION

The present invention relates to the art of fluid containment. It finds particular application in conjunction with tanks utilized in effluent disposal systems, such as septic tank effluent pump systems, variable grade sewer systems, and small diameter gravity sewer systems. However, it is to be appreciated that tanks in accordance with the invention are also suitable for storing fluids and fluid-type materials both above and below ground.

Sewage and septic systems have traditionally been constructed to receive fluid by gravity flow from a residence and discharge the fluid by gravity flow to an absorption field. The absorption field having excess fluid discharge capacity and being accessible to the in-flow of high ground water, no particular effort was commonly made to seal the tank or the connecting lines against ground water. During periods of high ground water levels, this leakage enabled additional fluid to flow into the tank to compensate for the increased hydraulic pressure of surrounding ground water and water saturated soil.

For better environmental control, septic systems are now being installed in which the tank connects with a central sewage processing station rather than a individual absorption field. Central sewage processing facilities are commonly designed to treat sewage at a preselected number of gallons per hour. The determination is made based on the number of homes connected with the central processing system and the average daily output of the homes, typically considered to be about 150 gallons per day. During heavy rains, ground water leakage into the prior art septic tanks and sewage systems can increase the flow rate to the central sewage processing facility by a factor of 10 or more. For example, a 1/32 inch wide gap around a 24-inch diameter riser under one inch of head would infiltrate 600 gallons per hour into the tank, i.e. four times the average daily discharge. To prevent the overloading of the treatment facilities, to save the cost of building greatly oversized central processing facilities, and to prevent the discharge of raw sewage during heavy rains, the septic tank and associated systems must be sealed against ground water.

Sealing the tank against ground water increases the tendency for in-ground tanks to collapse under the increased hydraulic pressure differential between high ground water and the tank interior. Collapsing is particularly prevalent when the ground water level exceeds the level of effluent within the sealed tank. The high ground water might collapse a tank directly. However, the high water more commonly distorts the carefully crafted structural shape of plastic tanks, cancelling the strength provided by the undistorted structure. The distortion related loss of strength leads to further distortion until the tank collapses or fails. Such distortion often occurs adjacent the upper portion of the tank which is above the internal effluent level.

Another common point of failure is at the flat bottom of the tank. Excessive hydrostatic pressure arches or distorts the bottom wall inward, drawing in the side walls. The distortion to the side wall corrugations reduces the structural strength that they provide, allowing further distortion and failure.

The hydraulic pressure differential has further been increased in systems in which fluid is pumped from the interior of the tank to the central processing station. This pumping tends to reduce the pressure within the sealed tank.

The present invention contemplates a new and improved tank which overcomes the above referenced problems and others.

SUMMARY OF THE INVENTION

In accordance with one aspect of the present invention, an improved generally spherical sealed, corrugated tank with a round access aperture in an apex area is provided. Specifically, an apex area reinforcing means is provided which prevents the area adjacent the apex aperture from becoming distorted under exterior hydrostatic pressure and soil loads. In this manner, the reinforcing means protects the tank against distorting and losing its structural shape and strength when it is surrounded by water-laden soil.

In accordance with another aspect of the present invention, an improvement is provided for generally spherical sealed, corrugated sewage tanks which have a bottom wall portion and side wall portions with generally vertical alternating ribs and valleys. The bottom of the tank tends to flex inward and the ribs and valleys tend to compress in an accordion-like manner under a large pressure differential between the tank interior and exterior. To prevent this distortion, the present invention provides a bottom area reinforcing means which increases resistance to inward flexation of the bottom and prevents compression of the valleys and ribs adjacent the bottom.

In accordance with yet another aspect of the present invention, a plastic tank is provided. The tank includes an inlet opening through which sewage or other fluid is received and an access opening for providing access to the interior of the tank. An outlet opening is defined in a side wall of the tank for receiving an outlet tube therethrough in a fluid-tight relationship. To assist in maintaining the fluid-tight relationship even under pump-induced outlet tube vibrations and transverse forces on the outlet tube due to settling or the like, a flexation means is provided in the tank side wall surrounding the outlet opening. The portion of the side wall inside the flexation means and immediately adjacent the outlet opening is enabled to flex and change planar relationships relative to the remainder of the side wall and tank. In this manner, the flexation means relieves stress which might otherwise be caused by any movement between the tank side wall and the outlet pipe.

One advantage of the present invention is that it provides increased resistance to tank deformation and collapse, even under large external hydrostatic pressures.

Another advantage of the present invention is that it provides a long-life, stable tank for septic tank effluent pump systems, variable grade sewer systems, small diameter gravity sewer systems, and the like.

Still further advantages of the present invention will become apparent to those of ordinary skill in the art upon reading and understanding the following detailed description of the preferred embodiments.

BRIEF DESCRIPTION OF THE DRAWINGS

The invention may take form in various parts and arrangements of parts. The drawings are only for purposes of illustrating a preferred embodiment of the invention and are not to be construed as limiting it.

FIG. 1 is a side-sectional view of a tank construction in accordance with the present invention;

FIG. 4 is an enlarged detailed view of a portion of FIG. 1 which illustrates the apex area reinforcing ring and interconnection between the riser and tank;

FIG. 5 is an enlarged detailed view of the interconnection between the riser and top closure; and, FIG. 6 is a bottom view of the tank of FIG. 1.

DETAILED DESCRIPTION OF THE PREFERRED EMBODIMENT

Figure 2:
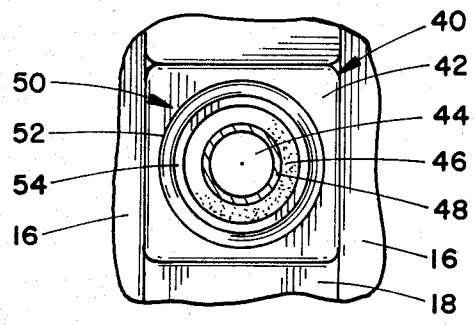
FIG. 2 is a partial side view along 2—2 of FIG. 1 of a pumped fluid outlet.

With particular reference to FIG. 1, a generally spherical, corrugated septic tank A is buried below grade. A riser B extends from an apex area of the tank to the surface. A pump assembly C is provided for selectively pumping effluent from the tank to a downstream processing station. Under severe hydrostatic loading, such as in heavy rains, which cause the tank to be immersed in water, mud, water-laden earth, or other fluid, the hydrostatic pressure tends to deform the shape of the tank. Actual deformation of the tank shape would, of course, degrade its structural integrity and could lead to collapse. To prevent such hydrostatic pressure-related failures, an apex area reinforcing means D is provided for fixing the shape of the apex area even under extreme loading conditions. Analogously, a base reinforcing means E fixes the bottom of the tank against deformation even under extreme hydraulic loading.

With continuing reference to FIG. 1, the tank A includes a side wall 10 which extends from an apex area 12 to a base area 14. The side wall is arcuate in vertical cross section and defines a plurality of alternating generally vertical ribs 16 and valleys 18, i.e. vertical corrugations arranged peripherally around the tank. A plurality of central rib portions 20 are disposed in the valleys and project outward substantially flush with the rib portions to provide a peripheral, belt-line rib centrally around the tank. Optionally, feet 22 may extend outward and downward from some or all of the rib portions to increase the surface area on which the tank is supported.

An inlet aperture 30 is defined in one of the valley portions. More particularly, the valley portion has a generally vertical wall section 32 which extends inward in an annular collar 34 for receiving an inlet structure 36. Although a T-baffle is illustrated, it is to be appreciated that other baffles, sweeps, and inlet structures may also be utilized. To accomodate the upper vent portion of T-baffles and other structures, the tank includes a raised area 38 above and radially inward from the inlet aperture.

With continuing reference to FIG. 1 and further reference to FIG. 2, the tank portion further defines an outlet opening area 40 in another of the side wall valley portions. The outlet area includes a generally vertical valley wall portion 42 through which a small diameter outlet opening 44 is defined. A resilient grommet 46 is disposed in the aperture to form a tight fluid seal with the outlet plumbing 48 which passes therethrough.

To facilitate movement of the outlet plumbing relative to the tank, the generally vertical wall portion 42 includes a flexation means 50, such as a series of concentric annular inward and outward projections 52. More specifically, the annular flexation projections 52 surround an outlet opening contiguous wall portion 54 enabling the plane of the outlet contiguous wall portion to move relative to the remainder of the vertical valley wall portion 42 and the side wall. Optionally, other structures which enable the outlet contiguous wall portion to move relative to the side wall may also be utilized. A raised area 56 is provided above the radially inward from the outlet opening. A contractor may optionally drill a larger outlet opening through the vertical wall portion 42 to accommodate conventional, large diameter outlet baffles and fittings.

Figure 3:
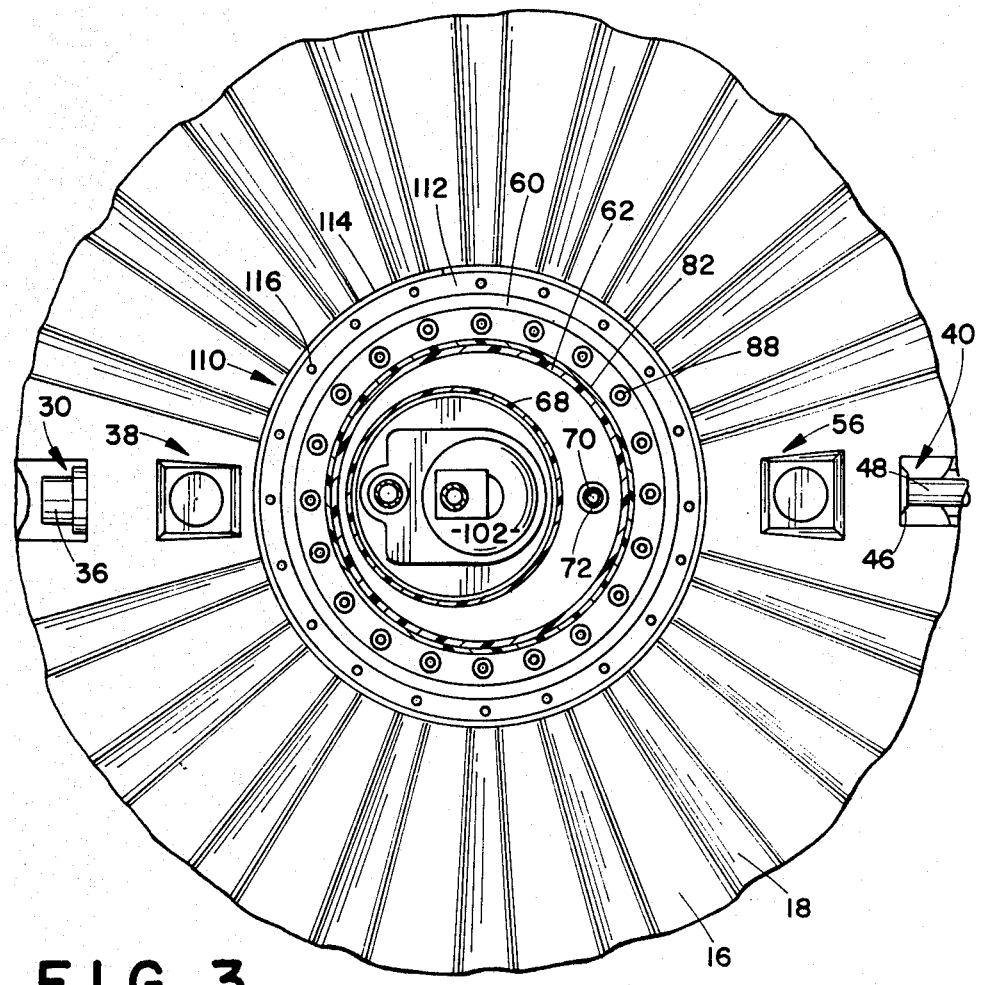
FIG. 3 is a top view in partial section taken along 3—3 of FIG. 1.

With continuing reference to FIG. 1 and further reference to FIG. 3, the tank apex area 12 includes a sloping portion 60 which merges into a generally vertical annular riser positioning portion 62. A generally flat, horizontal surface 64 defines an access aperture 66 for receiving a pump pod 68 therein. The horizontal apex area surface further defines an outlet plumbing aperture 70 fitted with a grommet 72 as a resilient, vibration damping isolator. Inspection ports may also be provided.

With continuing reference to FIGS. 1 and 3 and further reference to FIG. 4, the riser B includes a plurality of alternating horizontal ribs 80 and valleys 82 to define a plurality of horizontal corrugations extending peripherally therearound. At its lower end, the riser fits snugly on the apex upstanding flange 62 to fix the relative position therebetween. A water-resistant sealing means 84 is defined between the riser B and the tank A such that an infiltration-resistant seal is provided therebetween. In a heavy rain, the water table may be higher than the interconnection between the riser and the tank. The riser sealing means 84 is configured to provide a seal under the hydrostatic head of water at least as high as the top of the riser. In the preferred embodiment, the sealing means includes a resilient gasket 86 and a plurality of connectors 88 which lock the riser to the tank with the gasket compressed therebetween.

With particular reference to FIGS. 1 and 5, at its upper end, the riser receives a cover or lid portion 90 which is removably attached to the upper end of the riser. For example, a plurality of fasteners 92 may lock the lid and riser together. Optionally, a gasket or other sealing means may be provided between the lid and the riser to provide an infiltration-resistant seal therebetween.

With reference again to FIG. 1, the pump vault 68 defines one or more effluent receiving apertures 100 therethrough. The fluid receiving aperture is defined sufficiently high in the tank that the received fluid is substantially clear of solids and particulates. The pumping means C further includes an electric pump 102 and a fluid level controller 104 disposed within the pump vault. When the fluid level reaches a preselected height, the level controller causes the pump to be actuated to pump fluid through the outlet plumbing 48 to the downstream processing station. Optionally, other controls of the pump may be provided. For example, the pump control may include a timer or the like which prevents all the septic tanks within the system from pumping simultaneously. As another option, a central controller may enable the pumps serially or in groups.

With continuing reference to FIG. 1 and reference again to FIG. 4, the apex area reinforcing means D includes a structure which reinforces the apex area of the tank and inhibits deformation thereof. In the preferred embodiment, the reinforcing means includes a stainless steel ring 110 with a generally L-shaped cross section. A generally horizontal portion 112 inhibits the tank and apex area from being compressed with horizontal force, e.g. flattened front-to-back or side-to-side. A generally upstanding portion 114 prevents one portion of the apex area and tank from becoming elevated or depressed relative to the others. A plurality of fasteners 116 are provided for firmly securing the iron ring adjacent the apex area of the tank. In the preferred embodiment, the tank, riser, and reinforcing ring are all circular in horizontal cross section. The circular cross section of the reinforcing ring is advantageous, not only in matching the shape of the tank, but also for the stronger, structural properties associated with circular structures relative to polygonal structures.

Optionally, other apex area reinforcing means may be provided. For example, a reinforcing ring of fiberglass-reinforced plastic or other composites may also be utilized. The reinforcing ring may have other cross sections, such as rectangular, D-shaped, triangular, T-shaped, circular, and the like. Although the reinforcing ring is illustrated as being attached to the exterior of the tank, it is to be appreciated that the ring may also be connected with the interior. In a 1000 gallon tank, the pump pod opening and the interior of the tank are sufficiently large that a workman can enter and stand in the tank to attach the reinforcing ring. As yet another option, the reinforcing ring may be molded partially or completely into the plastic. Other structures which prevent the tank apex area from being deformed under large or uneven hydrostatic loads are also contemplated.

Figure 6:
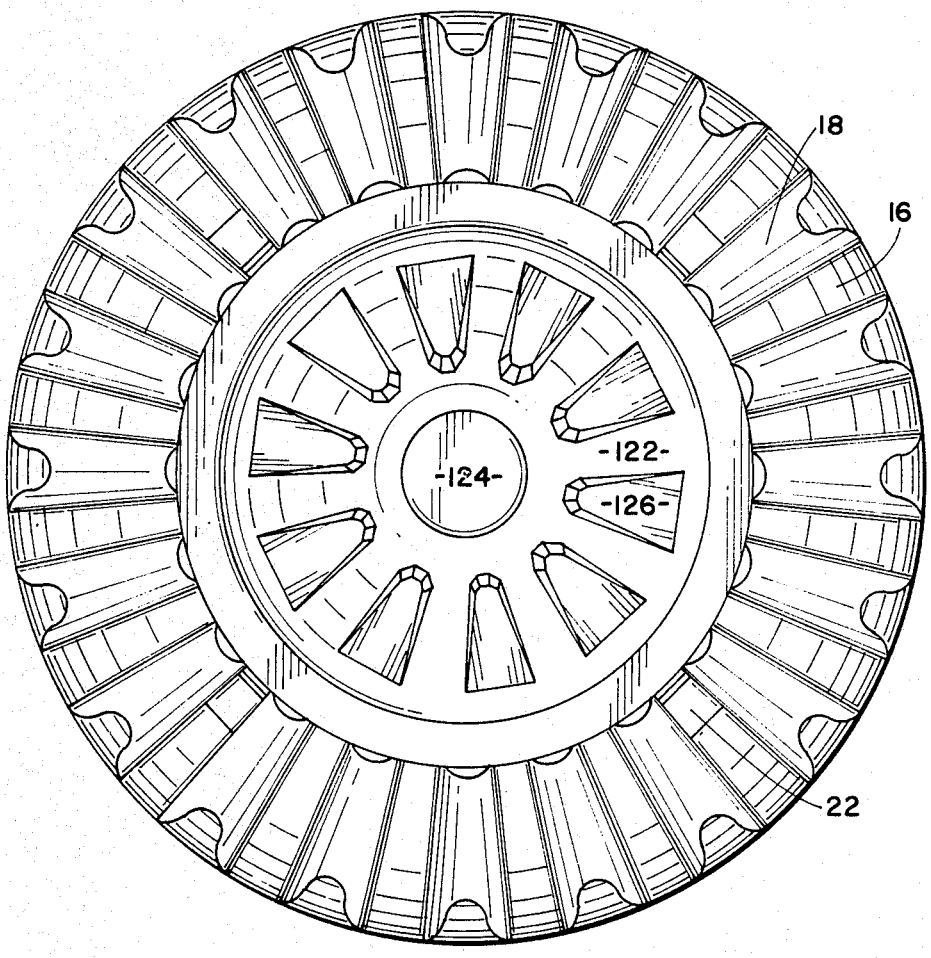

With continuing reference to FIG. 1 and further reference to FIG. 6, the bottom reinforcing means E includes a tank bottom structure 120 which increases the compression resistance of the tank bottom. In a prior art flat bottom tank, the bottom tended to arc inward under high hydrostatic loading drawing the corrugation ribs together and reducing the strength normally provided by corrugations. In the preferred embodiment, the tank bottom strengthening means E includes a domed or arched bottom wall 122. The arch maybe selected such that the bottom wall is at a neutral or balanced flexation point when urged inward by the maximum hydrostatic pressure for which the tank is designed and urged outward by the weight of the pump 102, pump pod 68, and fluid at a minimum operating level. To prevent the bottom from being flexed outward at less than maximum hydrostatic loading, a series of projections or structures are provided to support the internal load in the absence of hydrostatic loading. In the preferred embodiment, the supporting structures include a central can 124 which is surrounded by about ten generally wedge-shaped boxes 126. The can and boxes extend downward from the domed bottom surface 122 to a horizontal plane across the bottom of the tank to be supported on the gravel or other tank supporting structure.

Optionally, other tank bottom reinforcing structures may be utilized. For example, an annular ring 130 of fiberglass reinforced plastic, steel, or the like may be connected peripherally around the tank bottom surface. As another option, a peripheral rib 132 may be disposed in the tank interior along a lower portion of the side wall. Other structures for preventing the bottom portion of the side wall from moving inward or for preventing the bottom wall from flexing are also contemplated.

The invention has been described with reference to the preferred embodiment. Obviously, modifications and alterations will occur to others upon reading and understanding the preceding detailed description. It is intended that the invention include all such alterations and modifications in so far as they come within the scope of the appended claims or the equivalents thereof.

Having thus described the preferred embodiments, the invention is now claimed to be:

1. In a corrugated sewage tank which has generally vertically extending alternating ribs and valleys which define a corrugated side wall extending between a bottom wall and an apex area and which ribs and valleys tend to compress in an accordion-like manner and which apex area tends to become distorted under large pressure differentials between the tank interior and exterior, the improvement comprising:

an annular structure mounted to the tank and extending peripherally around the apex area for inhibiting the apex area from becoming distorted under exterior hydrostatic pressure when the tank is disposed in water-laden soil, the annular structure including a horizontally mounted portion to prevent horizontally inward compression of the apex area and a generally upward standing portion for preventing upward and downward deflection of portions of the apex area out of a plane defined by the annular structure.

2. The tank as set forth in claim 1 further including an outlet opening extending through the side wall for receiving an outlet pipe passing therethrough, the side wall defining a flexure means surrounding the outlet opening such that the portion of a side wall immediately contiguous to the opening is movable relative to the remainder of the side wall.

3. The tank as set forth in claim 2 wherein the flexure means includes at least one projection extending annularly around the outlet opening.

4. In a corrugated sewage tank which has a bottom wall and generally vertically extending alternating ribs and valleys which define a corrugated side wall extending between the bottom wall and an apex area and which bottom wall tends to flex inward and which ribs and valleys tend to compress in an accordion-like manner under large pressure differentials between the tank interior and exterior, the improvement comprising:

a bottom area reinforcing means for increasing resistance to inward flexation of the bottom wall and compression of the side wall valleys and ribs adjacent the bottom wall, the bottom area reinforcing means including an inwardly domed bottom wall, and a plurality of downward projections for preventing fluid in the interior of the tank from flexing the bottom wall outward.

5. In a generally spherical round, plastic tank which has an access aperture in an apex area of the tank and a riser extending upward from the apex area and around the access aperture, the improvement comprising:

an apex area reinforcing means for increasing resistance of the apex area adjacent the access aperture to becoming distorted under exterior hydrostatic pressure when the tank is at least partially immersed in water-laden soil, the apex area reinforcing means including an outward projection which projects generally perpendicular to the tank apex area and extends annularly around and displaced from the riser to inhibit distortion of the apex area.

6. The tank as set forth in claim 5 wherein the apex area reinforcing means includes a metal ring affixed to the apex area, the outward projection being defined by the ring.

7. The tank as set forth in claim 5 further including an outlet opening extending through the tank and annular projecting rings extending around the outlet opening such that the portion of the tank immediately contiguous the outlet opening is movable relative to the remainder of the tank.

8. In a corrugated plastic sewage tank which has a bottom wall, an apex area, and a side wall defined by generally vertical alternating ribs and valleys, which bottom wall and apex area tend to flex inward and which ribs and valleys tend to compress in an accordion-like manner under a large pressure differential between the tank interior and exterior, the improvement comprising:

a reinforcing means for increasing resistance to inward flexation of at least one of the bottom wall and the apex area which increases resistance to compression of the valley and ribs thereadjacent, reinforcing means including at least one rigid reinforcing ring which is attached to the tank adjacent one of the tank bottom wall and the apex area to constrain it against inward flexation such that the side wall ribs and valleys are held in an uncompressed configuration, such that loss of side wall strength attributable to the accordion-like compressing of the ribs and valleys is prevented.

9. In a corrugated plastic sewage tank which has bottom wall and a side wall defined by generally vertical alternating ribs and valleys, which bottom wall tends to flex inward and which ribs and valleys tend to compress in an accordion-like manner under a large pressure differential between the tank interior and exterior, the improvement comprising:

an inwardly doomed bottom wall portion; and, a plurality of downward projecting structures extending from the domed bottom wall portion generally to a horizontal plane across a bottom of the tank to inhibit outward deflection of the domed bottom wall.

10. A plastic tank comprising:

a side wall extending from a bottom wall area to an apex area;

an inlet opening defined through a first generally vertical section of the side wall;

an outlet opening defined through a second generally vertical section of the side wall; and, at least one annular groove molded into at least one of the first and second vertical side wall sections surrounding the corresponding one of the inlet and outlet openings for permitting a side wall portion between the groove and the opening to be moved relative to the remainder of the vertical side wall section to accommodate movement of a tube received in the opening.

11. The tank as set forth in claim 10 further including a resilient grommet mounted in the opening to provide a fluid tight seal with fluid conveying tubing passing therethrough.

12. The tank as set forth in claim 10 further including an apex area reinforcing means for preventing the apex area from becoming distorted when the tank is buried in soil which becomes water-laden and a bottom area reinforcing means for increasing resistance to inward flexing of a bottom wall of the tank.

13. A tank for pumped effluent septic systems, the tank comprising:

a bottom wall portion which is adapted to rest on a horizontal surface, the bottom wall having a round periphery;

a side wall connected with the bottom wall periphery in a fluid-tight seal and bowing outward and extending upward therefrom to an apex area, the side wall having a plurality of ribs and valleys extending generally vertically between the bottom wall and the apex area;

an access aperture defined at the apex area for allowing access to the tank interior, whereby a submersible pump and other structures are insertable and removable from the tank interior;

an annular riser extending upward from the apex area, the riser being connected with the apex area with a fluid-tight seal;

a waste water inlet interconnected with the side wall in a fluid-tight relationship for introducing waste water and preventing the infiltration of ground water into the tank;

a waste water outlet interconnected with the side wall in a fluid tight relationship for passing pumped waste water from the tank and preventing the infiltration of ground water into the tank; and, a reinforcing rib extending peripherally around the apex area for preventing distortion of the apex area and the side wall under external hydrostatic pressure.

14. The tank as set forth in claim 13 wherein the bottom wall is inwardly domed and includes a plurality of downward projections that rest on the horizontal surface to inhibit downard deflection thereof.

15. In a corrugated plastic sewage tank which has a side wall defined by generally vertical alternating ribs and valleys extending between a bottom wall and an apex area, an access opening protecting riser extending upward from the apex area, the apex area tending to become distorted under exterior hydrostatic pressure when the tank is disposed in water-laden soil which distortion permits the ribs and valleys to compress in an accordion-like manner reducing their structural strength permitting the tank to collapse, the improvement comprising:

a rigid, annular structure mounted to the tank apex area spaced from and extending peripherally around the riser, the annular structure having sufficient rigidity to inhibit the apex area from becoming distorted under the water-laden soil exterior hydrostatic pressure to prevent the ribs and valleys from compressing in the accordion-like manner such that the tank retains its structural strength under the water-laden soil exterior hydrostatic pressure, whereby the annular structure increases the rigidity of the apex area sufficiently for the tank to retain its shape and structural strength.

16. The corrugated plastic tank for subterranean installation, the tank comprising:

a corrugated side wall which extends from a bottom wall area to an apex area;

an opening defined through the side wall for receiving a generally horizontally extending section of tubing;

at least one corrugation defined in the side wall extending annularly around the opening to permit a side wall portion defined between the corrugation and the opening to move relative to the remainder of the side wall as the tubing length moves.

* * * * *